US010677269B2

(12) United States Patent
Lippett

(10) Patent No.: US 10,677,269 B2
(45) Date of Patent: Jun. 9, 2020

(54) HYDRAULIC SYSTEM COMBINING TWO OR MORE HYDRAULIC FUNCTIONS

(71) Applicant: Jack K. Lippett, Bassett, VA (US)

(72) Inventor: Jack K. Lippett, Bassett, VA (US)

( * ) Notice: Subject to any disclaimer, the term of this patent is extended or adjusted under 35 U.S.C. 154(b) by 0 days.

(21) Appl. No.: 16/117,362

(22) Filed: Aug. 30, 2018

(65) Prior Publication Data

US 2020/0072250 A1 Mar. 5, 2020

(51) Int. Cl.

| | |
|---|---|
| ***F15B 11/16*** | (2006.01) |
| ***F15B 13/02*** | (2006.01) |
| ***F15B 11/17*** | (2006.01) |

(52) U.S. Cl.

CPC ..... *F15B 11/16* (2013.01); *F15B 11/162* (2013.01); *F15B 11/17* (2013.01); *F15B 13/022* (2013.01); *F15B 2211/7053* (2013.01); *F15B 2211/7058* (2013.01); *F15B 2211/7135* (2013.01)

(58) Field of Classification Search

CPC ..... F15B 11/16; F15B 11/162; F15B 11/17; F15B 13/022

See application file for complete search history.

(56) References Cited

U.S. PATENT DOCUMENTS 4,369,625 A * 1/1983 Izumi ..... E02F 9/2292 414/699
4,561,341 A * 12/1985 Aikawa ..... F15B 11/17 414/687
4,815,614 A 3/1989 Putkonen et al.
5,673,558 A 10/1997 Sugiyama et al.
6,018,895 A 2/2000 Duppong et al.
6,145,287 A * 11/2000 Rosskopf ..... F15B 11/17 56/10.9
6,202,411 B1 3/2001 Yamashita
6,389,953 B1 5/2002 Altman et al.
6,431,050 B1 8/2002 Hausman et al.
6,494,025 B1 12/2002 Killen et al.
7,499,783 B2 3/2009 Oka
7,904,224 B2 3/2011 Kanayama et al.
7,975,475 B2 * 7/2011 Ramun ..... F15B 11/16 60/427
8,454,319 B2 6/2013 Kitani
8,943,819 B2 * 2/2015 Knussman ..... F15B 11/17 60/421
8,984,873 B2 * 3/2015 Opdenbosch ..... F15B 11/17 60/420
9,068,578 B2 * 6/2015 Opdenbosch ..... F15B 11/16
(Continued)

*Primary Examiner* — Michael Leslie
(74) *Attorney, Agent, or Firm* — Dunlap Bennett & Ludwig PLLC

(57) ABSTRACT

A hydraulic system embodying a method for combining two or more hydraulic functions from operatively associated distributor valves to selectively increase fluid flow using only hydraulic switches and valves is provided. Each two or more preselected hydraulic functions may each have a piloted diverter valve operatively associated with the other (s) so that when a control valve of the first hydraulic function is selectively positioned to a maximum pressure the first diverter valve actuates the second (and other) diverter valve (s) to couple to the first hydraulic function. Solving the problem where a user has two hydraulic flows that are limited by the diameter/distance of the hoses or pipes to a maximum flow rate almost regardless of pressure but needs to increase that flow to efficiently perform a task.

10 Claims, 2 Drawing Sheets

(56) References Cited

U.S. PATENT DOCUMENTS

| | | | | |
|---|---|---|---|---|
| 9,074,352 | B2 * | 7/2015 | Ramun | F15B 11/16 |
| 9,394,924 | B2 * | 7/2016 | Berg | F15B 11/17 |
| 9,574,329 | B2 | 2/2017 | Wu | |
| 9,788,482 | B2 | 10/2017 | Boruff et al. | |
| 2005/0102865 | A1 | 5/2005 | Bell et al. | |
| 2005/0204734 | A1 | 9/2005 | Oka | |
| 2006/0045717 | A1 | 3/2006 | Seymour | |
| 2008/0053332 | A1 | 3/2008 | Roy | |

* cited by examiner

HYDRAULIC SYSTEM COMBINING TWO OR MORE HYDRAULIC FUNCTIONS

BACKGROUND OF THE INVENTION

The present invention relates to hydraulic systems and, more particularly, to a hydraulic system embodying a method for combining two or more hydraulic functions from operatively associated distributor valves to selectively increase fluid pressure and flow using only hydraulic switches and valves.

In hydraulic equipment, such as a knuckle boom crane or a hydraulic excavator, there may be a need for increased hydraulic flow to one of a plurality of hydraulic attachments or devices, wherein it is very expensive and often impractical to modify an existing machine to increase the fluid flow of the entire hydraulic system to supply an increased volume of hydraulic oil pressurized to said one of the plurality of attachments/devices by installing larger valves or larger diameter hoses and fittings.

Prior art combines the flow from two hydraulic pumps in a priority function configuration. The most common way to combine oil flow at the attachment uses electro/hydraulic solenoids to divert oil using electric switches and computer software. Electro/hydraulic systems require infrastructure such as wiring and contact switches to enable the oil flow to be combined. The extra wiring system needed to support the solenoids as well as the interface with the existing hydraulic system, however, is difficult and expensive. Electrical wiring and switching is also prone to breakdown in a harsh work environment.

As can be seen, there is a need for a method for combining two or more hydraulic functions at the attachment from operatively associated distributor valves for selectively increasing fluid flow using only hydraulic switches and valves. Through combining the flow of a hydraulic medium from two or more hydraulic circuits at the point of use, the present invention enables the selected attachment to benefit from the increased hydraulic flow at comparatively lower cost and effort. Furthermore, by using only hydraulic actuators and valves, the present invention is a simple cost-effective solution that can be easily retrofitted on almost any hydraulic machine to improve the hydraulic flow performance of one of a plurality of hydraulic attachments without any other modification.

SUMMARY OF THE INVENTION

In one aspect of the present invention, hydraulic system includes a first hydraulic function; a second hydraulic function; each hydraulic function fluidly coupled to a diverter valve; a control valve operatively associated to each diverter valve for selectively setting a fluid pressure thereof between zero and a maximum pressure; and the diverter valves operatively associated so that the maximum pressure set for one of the diverter valves fluidly couples the other diverter valve to the one of the diverter valves.

In another aspect of the present invention, the hydraulic system includes a first hydraulic function; a second hydraulic function; each hydraulic function fluidly coupled to a diverter valve; a source of pressurized hydraulic fluid connected to each diverter valve; a control valve operatively associated to each diverter valve for selectively setting a fluid pressure thereof between zero and a maximum pressure; the diverter valves operatively associated so that the maximum pressure set for one of the diverter valves fluidly couples the other diverter valve to the one of the diverter valves; and no electric switches or computer software.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a hydraulic system embodying a method for combining two or more hydraulic functions from operatively associated distributor valves to selectively increase fluid flow using only hydraulic switches and valves. Each two preselected hydraulic functions may each have a piloted diverter valve operatively associated with the other so that when a control valve of the first hydraulic function is selectively positioned to a maximum pressure the first diverter valve actuates the second diverter valve to couple to the first hydraulic function.

Figure 1:
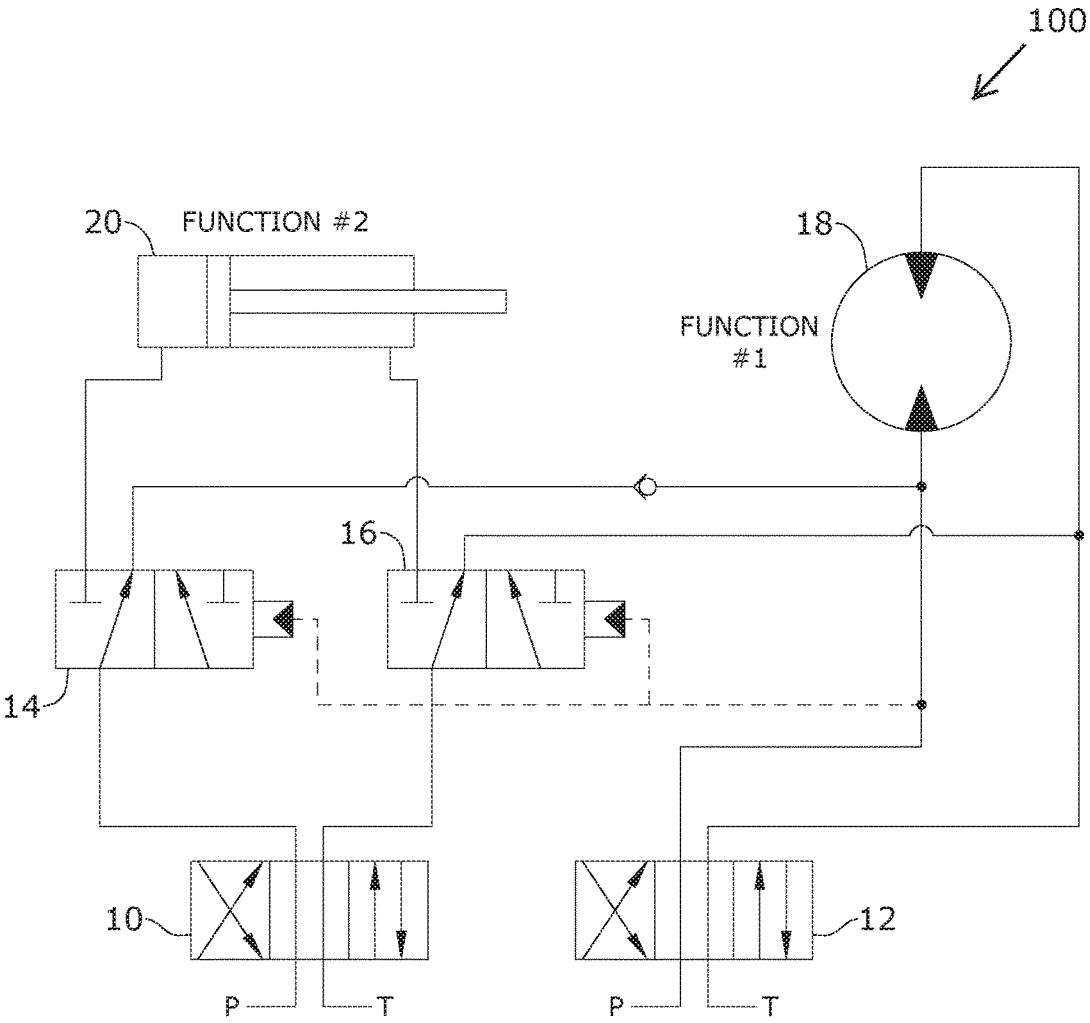
FIG. 1 is a schematic view of an exemplary embodiment of the present invention.
Figure 2:
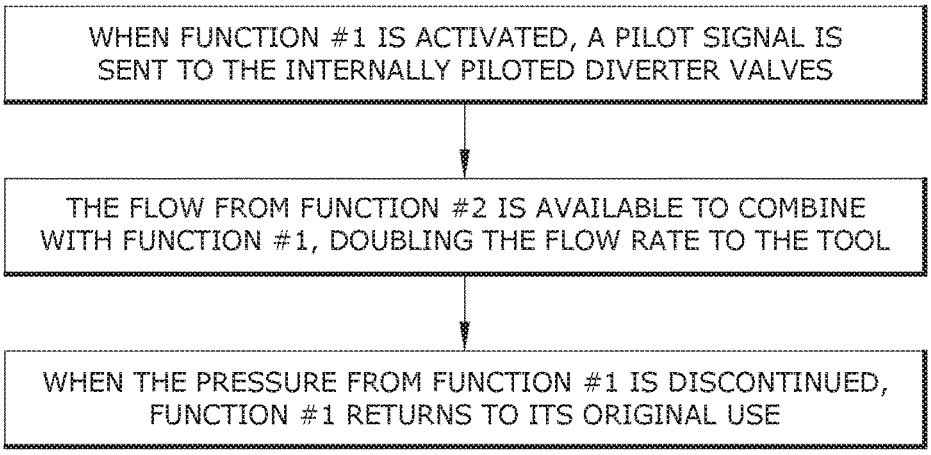
FIG. 2 is a flow chart of an exemplary embodiment of the present invention.
Figure 3:
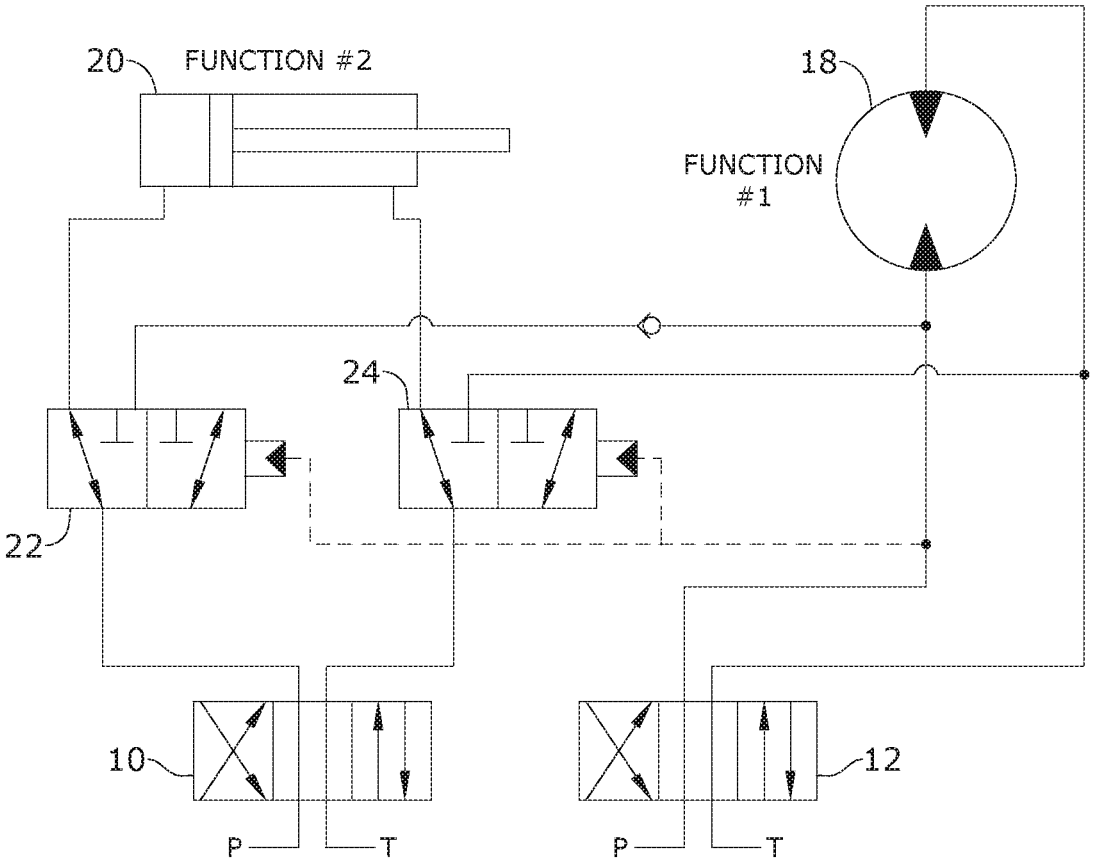
FIG. 3 is a schematic view of an exemplary embodiment of the present invention.

Referring to FIGS. 1 through 3, the present invention may include a method for combining two or more hydraulic functions embodying an arrangement of operatively associated piloted diverter valves.

When using a hydraulic attachment on a machine you normally have two or more functions connected to operate said attachment. The hydraulic system 100 includes at least first hydraulic function and a second hydraulic function both fluidly coupled to first and second diverter valves, respectively. Each hydraulic function is operatively associated with a control actuator 10 and 12 selectively movable among a pressure range between zero pressure and a maximum pressure, wherein each control actuator is fluidly coupled to pressurized fluid (P) and a reservoir tank (T). The first and second diverter valves 14 and 16 are operatively associated to actuate each other when the control actuator of the shared hydraulic function is moved to the maximum pressure. Thus, selectively actuating the first function to require the maximum flow also pressurizes a pilot or hydraulic cylinder that in turn causes the other diverter valve(s) to open, connecting the second function to the first function. By actuating the second function simultaneously a user automatically combines the two functions into one stream thereby effectively, in symmetrical arrangements. doubling the fluid flow pressure, without electric switches or computer software. When the user releases the actuator controlling the first function the second function returns to its normal function. In some embodiments, the first function may be a bi-directional fixed displacement motor 18, and the second function may be a double-acting cylinder 10.

In certain embodiments, the present invention may include a hydraulic manifold with two or more pilot operated cartridges 22 and 24 combined to create a pilot operated six-way valve or connecting a single acting spring loaded hydraulic cylinder to a manual six-way valve and using the hydraulic cylinder to shuttle the six-way valve on demand, as needed.

A simple ON/OFF selector valve would be added for those cases where this combined function would not be necessary. The essential element is the two or more hydraulically actuated diverter valves. It being understood, that satellite valves (not shown) can be operatively associated, coupled and/or incorporated to the hydraulic system 100 and/or the hydraulic manifold(s) embodied therein.

A method of using the present invention may include the following. The hydraulic system 100 disclosed above may be provided and coupled to a hydraulic attachment having two or more hydraulic functions, such as a hydraulic chain saw motor or a hydraulic motor on a grass cutting or brush cutting attachment needs specific fluid flow to perform correctly. The present invention enables hydraulic machinery that were not specifically configured to furnish that flow rate to be used with these types of attachments, each attachment associated with a respective hydraulic function controlled by a respective spool, depending upon the position of the spool within the control valve 10 and 12. The pilot valve and spool valves may be spring loaded to return the diverter valve state to directing pressurized fluid to/from the first hydraulic function if power is cut off to respective piloted diverter valve 14 and 16.

It should be understood, of course, that the foregoing relates to exemplary embodiments of the invention and that modifications may be made without departing from the spirit and scope of the invention as set forth in the following claims.

What is claimed is:

1. A hydraulic system, comprising:

a first hydraulic function fluidly connected with a first control valve;

the first control valve configured to select a fluid pressure between zero and maximum pressure for the first hydraulic function;

a second hydraulic function fluidly connected with a second control valve;

a second diverter valve fluidly coupled in series between the second control valve and both the second hydraulic function and the first hydraulic function, wherein the second diverter valve is movable between a non-actuated function and an actuated function, wherein the non-actuated function prevents flow from the second control valve to the first hydraulic function and wherein the actuated function prevents flow from the second control valve to the second hydraulic function;

a hydraulic pilot fluidly coupled between the first control valve and the second diverter valve; the hydraulic pilot configured so that only said maximum pressure moves the second diverter valve from the non-actuated function to the actuated function, whereby the actuated function is enabled without electrical power and without computer software.

2. The hydraulic system of claim 1, further comprising a source of pressurized hydraulic fluid connected to the second diverter valve.

3. The hydraulic system of claim 1, further comprising a spool within each control valve, wherein each spool controls a respective function depending upon a position of the spool within said control valve.

4. The hydraulic system of claim 1, wherein the first hydraulic function is a bi-directional fixed displacement motor.

5. The hydraulic system of claim 1, wherein the second hydraulic function is a double-acting cylinder.

6. The hydraulic system of claim 1, wherein the second diverter valve is not electrically coupled to one or more electric switches and wherein the second diverter valve is not electrically coupled to a computing device.

7. The hydraulic system of claim 1, further comprising a spool within each control valve, wherein each spool controls a respective function depending upon a position of the spool within said control valve.

8. The hydraulic system of claim 1, wherein the first hydraulic function is a bi-directional fixed displacement motor.

9. The hydraulic system of claim 1, wherein the second hydraulic function is a double-acting cylinder.

10. A hydraulic system, comprising:

a first hydraulic function fluidly connected with a first control valve;

the first control valve configured to select a fluid pressure between zero and maximum pressure for the first hydraulic function;

a second hydraulic function fluidly connected with a second control valve;

a first diverter valve fluidly coupled in series between the first control valve and both the first hydraulic function and the second hydraulic function, wherein the first diverter valve is movable between a first non-actuated function and a first actuated function, wherein the first non-actuated function prevents flow from the first control valve to the second hydraulic function and wherein the first actuated function prevents flow from the first control valve to the first hydraulic function;

a first hydraulic pilot fluidly coupled between the second control valve and the first diverter valve; the first hydraulic pilot configured so that only said maximum pressure moves the first diverter valve from the first non-actuated function to the first actuated function;

a second diverter valve fluidly coupled in series between the second control valve and both the second hydraulic function and the first hydraulic function, wherein the second diverter valve is movable between a second non-actuated function and a second actuated function, wherein the second non-actuated function prevents flow from the second control valve to the first hydraulic function and wherein the second actuated function prevents flow from the second control valve to the second hydraulic function;

a second hydraulic pilot fluidly coupled between the first control valve and the second diverter valve; the second hydraulic pilot configured so that only said maximum pressure moves the second diverter valve from the second non-actuated function to the second actuated function a source of pressurized hydraulic fluid connected to each diverter valve;

wherein each diverter valve is not electrically coupled to one or more electric switches and wherein each diverter valve is not electrically coupled to a computing device.

* * * * *